United States Patent [19]

Valenti

[11] 4,165,221

[45] Aug. 21, 1979

[54] FORMED CARBON FUEL BRIQUETTES, PROCESS FOR FORMING THE SAME AND PROCESS FOR UTILIZING THE SAME IN THE MANUFACTURE OF STEEL

[75] Inventor: Nicholas Valenti, Mayfield Heights, Ohio

[73] Assignee: Ohio & Penna. Fuels, Inc., Akron, Ohio

[21] Appl. No.: 954,379

[22] Filed: Oct. 24, 1978

[51] Int. Cl.[2] ..... C10L 5/12; C10L 5/40; C21B 5/00

[52] U.S. Cl. ..... 44/26; 44/1 F; 44/10 C; 44/16 R; 75/42

[58] Field of Search ..... 44/1 F, 10 C, 16 R, 44/17, 26

[56] References Cited

U.S. PATENT DOCUMENTS

| | | | |
|---|---|---|---|
| 33,020 | 8/1861 | Quann | 75/42 |
| 1,507,674 | 9/1924 | Nagel | 44/16 R |
| 1,562,564 | 11/1925 | Kattner | 44/26 |
| 2,582,386 | 1/1952 | Komarek | 44/26 X |
| 2,665,977 | 1/1954 | Engelhart | 44/26 |
| 4,078,902 | 3/1978 | Olson | 44/10 C |

*Primary Examiner*—Carl Dees

*Attorney, Agent, or Firm*—Sughrue, Rothwell, Mion, Zinn and Macpeak

[57] ABSTRACT

Formed fuel briquettes of high green strength, high shatter and good compressive strength in the cured state from a composition comprising coke breeze, an aqueous solution comprising ammonium polyphosphate and magnesia. The product can be easily formed by mixing all components at room temperature, introducing the same into a mold and thereafter permitting the same to set. Setting is very rapid, and the product can be handled within minutes after molding.

The product finds particular use as a replacement in whole or in part for coke in a steel-making process; it has the excellent advantages that the carbon content thereof is extremely high, which can approximate that of high-grade coke, and introduces no harmful impurities into steel during steel making.

11 Claims, No Drawings

FORMED CARBON FUEL BRIQUETTES, PROCESS FOR FORMING THE SAME AND PROCESS FOR UTILIZING THE SAME IN THE MANUFACTURE OF STEEL

BACKGROUND OF THE INVENTION

1. Field of the Invention

The present invention relates to formed fuels, processes for forming the same and processes for utilizing the same in steel making.

2. Description of the Prior Art

Perhaps the most commonly used method of melting iron is through the use of a cupola wherein coke, a fluxing material such as limestone, and a metallic material are charged. The coke is ignited and air is blasted into the bottom of the cupola to generate intense heat, melting the iron which then trickles down through the fluxing material and the coke to the bottom of the cupola. A molten slag is formed on the top of the charge and typically comprises coke ash and similar materials.

The coke used in the charge in most steel-making processes today is high-quality metallurgical grade coke which is produced by the distillation (in the absence of oxygen) of coal.

After the distillation to form high-grade metallurgical coke, handling methods in common use are such that the relatively brittle chunks of coke break up and form a very fine particulate form of coke called "coke breeze." In general, all coke particles that pass through a one-inch mesh size are too fine for use in a cupola melting process, and are typically discarded by the steel-making industry.

The reason that coke breeze cannot be used in the steel making industry is that the air blast and intense heat either immediately consume the coke breeze or blow it out of cupola, with the coke breeze contributing little or nothing to yield heat and potentially creating the danger of explosion. Coke breeze also tends to reduce the necessary freedom of air flow through the melt.

Typically, coke breeze will represent about 10% of the total amount of coke fed to a cupola.

Attempts have been made in the prior art to form coke breeze into briquettes. However, prior art briquettes have been subject to a number of problems, viz.

The most common problem of prior art coke briquettes is that the briquettes have been too brittle to withstand bulk handling and crumble or break into coke breeze.

Attempts have been made to use high proportions of binder to overcome this problem, but when the amount of binder has been increased to an extent that the briquettes are no longer brittle, the amount of binder is so high that it leads to an undesirable amount of slag in the steel-making process and actually can introduce undesirable impurities into the steel, reducing product value.

A further problem of many prior art processes is that high heating conditions are required to form the charge to be briquetted, very high pressures are necessary to form the briquette, or high temperature or extended curing times are necessary to form the briquette.

The present invention permits all of the above disadvantages of the prior art to be overcome, and provides a product completely compatible with the charge to a steel-making process which is substantially identical in product characteristics to high-grade metallurgical coke.

In addition, the product of the present invention is formed by a simple process at ambient conditions and requires no complicated processing equipment.

Finally, in the product of the present invention, very low amounts of binder are used, whereby the carbon content of the product of the present invention is suitable for steel making in a manner similar to high-grade metallurgical coke.

U.S. Pat. Nos. 2,665,977, Engelhart, 4,063,944, Behring, 4,078,902, Olson, and 3,762,886, Triska, disclose fuel briquettes using cement as a binder, certain of these patents disclosing coke breeze being bound by the cement.

Fuel briquettes formed in accordance with this type of prior art is subject to the fault that they exhibit a high ash content and cement is alien to steel-making processes.

U.S. Pat. Nos. 2,508,878, Yates et al., and 2,979,388, Brown et al., disclose the use of organic materials such as asphalt, pitches, thermal tars, and the like, as a binder for a carbonaceous material. Coke breeze is not disclosed, and the products of these two patents differ substantially from those of the present invention. The Yates et al. patent does disclose the combination of magnesium oxide, carbon, and pitch as a binder, but the processing sequence described is a high-temperature sequence and the briquettes are heated in the absence of air to carbonize the pitch.

These two patents are subject to the fault that binder materials as are utilized are essentially viscous materials, and they break down during the steel-making process at too early a stage to effectively function in a manner similar to coke.

U.S. Pat. No. 3,676,162, Mehler et al., discloses a basic refractory material for lining steel converters which comprises sintered magnesia bonded with sodium polyphosphate or magnesium sulphate and impregnated with liquid tar. Such a product has a utility exactly opposed to that of the product of the present invention.

U.S. Pat. Nos. 3,879,209 and 4,059,455, both to Limes et al., and 3,960,580, Stierli et al., disclose fast-setting concrete compositions which include magnesia and ammonium polyphosphate. There is no suggestion in any of these patents that the binder systems disclosed would be useful for binding a fine material such as coke breeze, nor, of course, that the binder systems described could be utilized to form a fuel briquette with the unique characteristics of the present invention.

The following patents generally deal with briquetting finely divided materials: U.S. Pat. Nos. 1,507,674, Nagel, 1,661,636, Simpson, 2,029,309, Curtis et al., 2,711,951, West et al., 3,617,254, Emperato, Jr., 3,674,449, Schmalfeld et al., 3,730,692, Halowaty et al., 3,838,988, Sanada et al., 3,841,849, Beckmann, and 4,015,977, Crawford.

In all of these patents, there is no disclosure of the unique fuel briquette of the present invention nor the properties thereof.

U.S. Pat. Nos. 3,285,758, Limes et al., and 3,413,385, Komac et al., deal with basic refractory compositions and processes for repairing refractory walls, respectively, wherein a magnesia/ammonium phosphate binder is used.

U.S. Pat. No. 3,708,317, Owen, discloses a metallurgical furnace lining and U.S. Pat. No. 3,826,662, Paolini, discloses a trowlable patching mix for refractory linings containing coke breeze, fire clay and pitch.

SUMMARY OF THE INVENTION

The present invention relates to a fuel briquette possessing unique characteristics for replacing, in whole or in part, coke, including, but not limited to, high-grade metallurgical coke, in a foundry, blast furnace and/or other steel-making applications, which fuel briquette is formed by a simple process.

In more detail, one object of the present invention is to provide a fuel briquette which permits a waste material generated during the handling of high-grade metallurgical coke to be efficiently and economically utilized, viz, coke breeze.

A second object of the present invention is to provide a fuel briquette which has excellent green strength and can be handled safely with minimal breakage within minutes after molding the same.

A third object of the present invention is to provide fuel briquettes which possess excellent shatter and compressive strength.

Yet another object of the present invention is to provide fuel briquettes which can be used as part of a cupola charge, which burn evenly and smoothly throughout the steel-making process, and which has characteristics substantially identical to cupola coke until completely consumed in the steel-making process.

Yet a further object of the present invention is to provide a fuel briquette for use in the steel-making process which has a carbon content approximating that of coke currently used in foundry, blast furnace and/or steel-making processes, including, but not limited to, high-grade metallurgical coke, i.e., which contains high proportions of coke breeze and low proportions of binder, and is useful as a partial or complete replacement for coke in such processes.

Yet another object of this invention is to provide a fuel briquette for use in the steel-making process which introduces substantially no detrimental impurities into the resultant steel and which yields lessened amounts of slag contributing products.

A further object of the present invention is to provide a simple process for forming such fuel briquettes, which process can be practiced at ambient temperature with or without compressive molding and without the need for high-temperature curing with simplified apparatus.

A final object of the present invention is to provide a steel-making process using fuel briquettes as above described.

The fuel briquettes of the present invention are formed from a mixture comprising coke breeze, magnesia and an aqueous solution comprising ammonium polyphosphate(s).

The process of the present invention simply comprises mixing the three components identified, substantially immediately pouring the resulting mixture into a mold, permitting the same to sit for a few minutes at ambient temperature or at an elevated temperature if desired, and thereafter removing the same from the mold. In an optimal embodiment, the mixture can be subjected to compressive molding, if desired.

The steel-making process of the present invention is substantially equivalent to conventional steel-making processes, except that high-grade metallurgical coke can be replaced in whole or in part by the fuel briquette of the present invention.

DESCRIPTION OF THE PREFERRED EMBODIMENTS

Hereafter, all percentages, parts and like figures are by weight, unless otherwise indicated.

Product Aspects

As indicated, the fuel briquettes of the present invention are formed from a composition which includes the following essential components: coke breeze, magnesia and an aqueous ammonium polyphosphate solution.

The Coke Breeze

The coke breeze as used in the present invention is conventional, i.e., it is a waste product from the bulk handling of high-grade metallurgical coke.

I have found that coke breeze as is generally available as a waste product is useful in the present invention. Coke breeze often will have a particle size range including relatively large particles down to very fine dust-like particles, and such can be used herein. Alternatively, if the coke breeze has been sized to a fairly uniform diameter, such can also be used in the present invention.

While not limitative as a critical parameter, typically, coke breeze will comprise particles having a size of about 2 inches or less. Larger particles, of course, could be used herein, but generally such are useful per se as coke and are not economical in the present invention. The minimum size of coke breeze is not important since the present invention can be practiced even with dust-like breeze. Commonly, the coke breeze will comprise a mixture of particles having a size of from 2 inches minus or smaller with 1 inch minus or smaller coke breeze being more commonly available.

It is not necessary that the coke breeze used in the present invention be treated in any special fashion prior to forming the fuel briquettes of the present invention, i.e., it can be used directly in its form as a waste material from the bulk handling of high-grade metallurgical coke. Generally, however, I most prefer that the coke breeze have a moisture content of about 6% or lower, by weight. Too high a moisture content will tend to somewhat reduce the strength of the final fuel briquette, and such is undesirable. In those instances where the coke breeze has an excessively high moisture content, it is preferred that the coke breeze either be dried or mixed with coke breeze which is drier to provide a final moisture content of, e.g., about 3 to about 6%, by weight, or lower.

The Magnesia

The magnesia used in the present invention serves as a source of magnesium oxide. It does not enter into the steel-making process but assists in permitting the aqueous ammonium polyphosphate to set up to serve as a binder. Thus, there is no particular limitation on the particle size of the magnesia so long as it presents sufficient surface area, either by being of a relatively fine size and/or through adequate mixing, to set the aqueous ammonium polyphosphate solution. The magnesia can, if desired, be of a substantially uniform size or have a particle size range down to dust-like powder. I have found that magnesia of $\frac{3}{8}$ inch minus functions well in the present invention, and, hence, such is preferred, but this is not limitative as the magnesia particle size is selected to provide desired density and other properties in the fuel briquette.

The magnesia used in the present invention can be pure MgO, but this is not preferred or necessary. More typically and preferably, it is in the form of highly calcined or dead-burned magnesite of a fine particle size, or may be calcined dolomite having a substantial magnesia content. What is important at this point of the invention is that any such particulate magnesium oxide source be capable of reacting with the phosphates to produce a bonded structure. Impurities, i.e., non-MgO materials, as are commonly found in the above-identified commercially available industrial materials have not to date been found to be harmful (typical impurities are CaO, $SiO_2$, $Al_2O_3$, $Fe_2O_3$). I prefer, however, that any calcined or dead-burned magnesite or calcined dolomite have an MgO content of at least about 80%, more preferably about 87% or greater, though this is not mandatory. While the above magnesia materials can be used alone or as mixtures thereof, I most prefer to use dead-burned magnesite as the magnesium oxide source.

Hereafter, for brevity, I will merely use the term "magnesia" to generically refer to all of the above materials which serve as a source of MgO for ammonium polyphosphate setting.

The Ammonium Polyphosphate

The ammonium polyphosphate of the present invention is used in aqueous form.

Ammonium polyphosphate materials as described in U.S. Pat. Nos. 3,879,209, Limes et al., and 4,059,455, Limes et al., both hereby incorporated by reference, can be used with success in the present invention, though the present invention is not limited thereto.

The strength or concentration of ammonium polyphosphate in the aqueous ammonium polyphosphate solution of the present invention is not overly important so long as sufficient ammonium polyphosphate is present in the fuel briquette of the present invention to serve its binding function in combination with the magnesia.

Typically, aqueous ammonium polyphosphate solutions as are commercially available have a 30% or higher phosphate concentration, e.g., 30–37%, by weight, phosphate, and such are preferably used in this invention. The water content of such commercial aqueous ammonium polyphosphate solutions is typically about 50%, balance impurities, though water content is not especially limited so long as the necessary amount of phosphates can be put into solution. Nothing is gained by excessive water being present, and little need has presented itself to date to either dilute or concentrate such commercially available aqueous ammonium polyphosphate solutions.

It is preferred in accordance with the present invention that of all phosphates present in the aqueous ammonium polyphosphate solution of the present invention, at least about 20%, by weight, be polyphosphates, and it is most preferred that at least 60%, by weight, of all phosphates present be polyphosphates. The polyphosphates are typically principally pyrophosphate with minor higher polyphosphates, such as tripolyphosphates and higher phosphates, and can be essentially all pyrophosphate. The balance of the phosphates present is typically orthophosphate, in many cases it being preferred that 30–40% orthophosphate, based on all phosphates present, be used. Thus, in a most highly preferred form of the invention, the aqueous ammonium polyphosphate solution comprises about 50% water, 30–37% ammonium phosphates (which break down to 70–80% ammonium polyphosphates —pyrophosphate or higher—and 20–30% ammonium orthophosphate), balance inert impurities. The exact nature of the ammonium polyphosphate is not important so long as it is in the pyrophosphate form or higher.

For certain embodiments, the aqueous ammonium polyphosphate solution used is a mixture of the ortho-, pyro- and poly- (tri and higher) forms with at least 20%, by weight, pyro-/poly-forms where at least 2%, by weight, are in the poly-form. In all embodiments, of course, the active phosphates are in the ammonium form. Typically, the aqueous ammonium polyphosphate solution comprises about 8–12% ammoniacal nitrogen.

Product Proportions

The amounts of the essential components coke breeze, aqueous solution of ammonium polyphosphate(s) and magnesia are as follows.

Aqueous solution of ammonium polyphosphates

For this section, I merely refer to the above component as the "solution." Further, since the phosphate proportion is more easily expressed as parts of $P_2O_5$, that parameter is used herein.

The solution is used in an amount to provide at least about 1 part of $P_2O_5$ per 100 parts of magnesia and coke breeze.

However, at amounts of solution providing only about 1 part $P_2O_5$, it is possible higher temperatures and compression will be needed to form a good fuel briquette. Thus, I prefer to use an amount of the solution which will provide at least about 3 parts $P_2O_5$ per 100 parts coke breeze and magnesia, and have found superior product characteristics using the solution in an amount to provide about 3 parts $P_2O_5$ per 100 parts coke breeze and magnesia.

The maximum amount of the solution used is less critical than the minimum from the viewpoint of insuring an effective binding function, but if too high a proportion is used, the fuel briquette takes on a glassy sheen, indicating excess solution is present. Thus, a simple test to determine excessive solution is whether the fuel briquette presents a glassy, reflective surface as opposed to a dull, non-reflective surface. The exact amount of solution preferably used depends on the amount of magnesia and the particle size of the magnesia and coke breeze, but I believe that best results are encountered during use if the solution provides no more than about 10 parts $P_2O_5$ per 100 parts of coke breeze and magnesia. Since I find lesser parts $P_2O_5$ to be very satisfactory, I see no current need to use such higher proportions of the solution, the most expensive component of the fuel briquette, though such could probably be used with very exacting control of the setting (curing) conditions.

Magnesia

The magnesia should comprise at least about 1%, by weight, of the coke breeze, and to avoid the need for excessive mixing prior to setting, I prefer to insure that the magnesia comprises about 9% to about 12% of the coke breeze. While such high proportions of magnesia are not theoretically required, they permit me to conduct mixing without having to pay critical control to either mixing intensity or time or magnesia particle size and still obtain a highly useful product. I believe that if I used finely divided magnesia and/or intense expensive or long-term mixing, I could achieve the same results with low magnesia percentages as with higher since I would insure high phosphate/magnesia contact.

Higher proportions of magnesia can be used, of course. For example, it does not seem that high magnesia proportions have any harmful affect on the fuel briquette, but since magnesia has a cost much higher than coke breeze, the use of higher amounts thereof tends to defeat one purpose of my invention, i.e., to enable large amounts of a current waste material (coke breeze) to be used on a cost-competitive basis with virgin metallurgical coke.

Simply stated, the minimum proportion of magnesia is important to insure good, easy bonding with the aqueous solution of ammonium polyphosphate(s), but the maximum amount thereof seems to be more economically oriented, i.e., after an amount sufficient for bonding with the solution is present, the excess does not assist bonding, remains inert at use and, very importantly, displaces coke breeze, which is not only needed in the use of the fuel briquette but is of very low cost. For example, amounts of magnesia up to, e.g., 20%, by weight, or higher, provide bonding but harmfully lower the coke breeze content and increase cost unnecessarily.

Coke breeze

The coke breeze comprises the balance of the fuel briquette.

Additives

The present invention does not exclude the use of additives. These are optional in this invention and are conventional, i.e., you can use conventional coke or brick additives as desired, e.g., to increase the carbon content or ease fuel briquette processing as desired. This emphasizes the essential nature of the fuel briquette of this invention. Unless the additive adds to the essential nature of the coke breeze, e.g., a carbon increaser, I prefer to use low amounts thereof, e.g., less than about 10%. Since the aqueous ammonium polyphosphate solution and magnesia will, of course, slightly reduce fixed carbon, the fixed carbon content can be brought to a higher specified carbon level with a carbon increaser such as a high carbon ground, such as C-coal or petroleum coke.

Processing Conditions

The process of the present invention in its basic form is simple. Coke breeze, magnesia and aqueous ammonium polyphosphate solution are mixed in the proportions earlier recited, substantially immediately placed into a mold and then permitted to set therein for a few minutes, typically at least about 3 minutes.

The conditions selected for mixing are not overly important so long as the coke breeze, magnesia and aqueous ammonium polyphosphate solution are well mixed, most desirably uniformly dispersed throughout the composition. Mixing in theory can take only a few seconds, and is conducted in a conventional manner. Usually I mix for at least about 1 minute to ensure good dispersion.

The time after the completion of mixing to introduction into the mold is not critical in the sense that it must be done within seconds, but since the composition begins to set once the aqueous ammonium polyphosphate solution and magnesia contact each other, one should not delay in introducing the composition into the desired mold after setting has excessively proceeded since in this case molding cannot be conducted. The time involved is a matter of common sense, and typically upon the completion of mixing I thereafter substantially immediately introduce the composition into the desired mold.

While I have found that at ambient conditions setting in the mold for typically a period of about 3 minutes is sufficient, if the composition is permitted to set in the mold for a longer period the fuel briquette will gain additional strength.

Mixing and setting (curing) can be conducted at ambient or at elevated temperature. If at ambient temperature, somewhat longer setting times are required during the winter with shorter setting times being required during the summer. For safety, at ambient temperature I usually permit the composition to set for at least about 2 minutes and seldom have found it necessary to permit the composition to set for more than about 5 minutes. The fuel briquettes can, at that stage, be safely handled since they quickly illustrate excellent green strength.

The general rule I have found is that increasing the temperature of setting decreases the time required for the briquettes to illustrate excellent green strength. With commercial heating apparatus I have found that elevated temperatures on the order of 325° F. to 475° F. are easily attained, whereby one can set the fuel briquettes of the present invention in less than about 2 minutes.

The elevated temperatures for setting (curing) can be obtained using any conventional apparatus, for instance, infrared heaters, propane heaters, other types of gas heaters, and the like. Devices providing higher or lower heating temperatures can be used, of course, but lower temperatures do not speed setting much over ambient and the complexity of higher temperature operation is essentially unfavored.

Quite often I initially set at ambient for, e.g., at least about 2 minutes, and then follow with a brief "post-setting" at a higher temperature, e.g., at about 325° F.–475° F. This speeds processing and appears to provide an initial product with higher green strength.

Often it is convenient to compress the setting mixture just after introduction into the mold. Since the setting composition is plastic during the initial period of setting (curing), compression appears to slightly increase the density of the fuel briquette and make the same somewhat easier to handle. Compression can be by any conventional means, and usually I only compress by an amount equivalent to hand tamping.

The size of the fuel briquette is not especially limited except that the briquette should be at least the size of commercially used coke and should not be so large that it is not easily handled. Briquettes about the size of a small loaf of bread are easily fabricated and handled, however.

Having thus generally described the present invention, the following example of the currently preferred best mode of practicing the present invention is offered.

EXAMPLE 1

The coke breeze utilized was taken directly from waste at a large steel-making plant. It had a final screening size of ¾" minus×0 inch. The moisture content was on the order of 3–6 weight percent. It had not been subjected to any special treatment, and comprised a mixture of coke breeze particles from a fine powder size up to pass a ¾" mesh, randomly distributed.

The magnesia selected was dead-burned magnesite. It had a random particle size distribution such that 100% passed ⅜" minus, the particles ranging from just pass ⅜" mesh to fine powder. Its chemical composition was as follows (all percentages are weight percentages):

MgO—87.3%
$SiO_2$—4.6%
CaO—4.2%
$Fe_2O_3$—2.7%
$Al_2O_3$—1.2%

It was a commercially available product from Basic Refractories under the name BRI Magnesite DB-87.

The aqueous ammonium polyphosphate solution comprised 50% water. The total $P_2O_5$ was 34.0 weight percent. Of the total $P_2O_5$ present, 72.0 weight percent was polyphosphate. The balance of the solution was impurities. The solution was available under the name Tgreen Solution 10-34-0 from Texas Gulf, Inc. According to their analysis the specific gravity at 75° F. is 1.395, pH is 5.95, and the apparent Brookfield viscosity at 40° F. is 80 cp. For purposes of the present invention, the only important parameters are total $P_2O_5$ and polyphosphate of the $P_2O_5$. Total nitrogen was 10 wt. %.

Using the above components, I firstly mixed two pounds of coke breeze with three ounces of the magnesia in a conventional mixing apparatus having a vertically oriented stirrer.

I then added three ounces of the aqueous ammonium polyphosphate solution, and vigorously mixed all components for one minute in the same apparatus until the mixture gained plasticity.

I then placed the resulting mixture into a rectangular mold and hand tamped the resulting mixture into place.

In this process run, after two minutes in the mold at ambiend temperature, I thereafter heated the fuel briquette at 475° F. for two minutes while the same was in the mold. The fuel briquette was then removed from the mold.

The fuel briquette had sufficient green strength to be easily handled without breakage upon removal from the mold, and, after heating at the recited conditions, had already retained a set sufficient to serve as a replacement for metallurgical grade coke in steel making. The briquette had dimensions of approximately 3"×4"×10".

An independent testing laboratory's provisional written report indicated a proximate analysis of the resulting briquette showed that it had the following composition (dry basis):

11.00% ash;
1.50% volatile;
87.50 fixed carbon; with mineral analysis thereon providing the following results:

phosphrous pentoxide 0.38
ferric oxide 23.49
alumina 18.40
potassium 1.34
lime 5.40
magnesia 1.71
balance titania, sodium oxide and undetermined.

Steel-Making Aspects of the Present Invention

As earlier indicated, the fuel briquette of the present invention finds particular use as a partial or complete replacement for metallurgical coke in conventional steel-making processes, including not only the steel making step per se but in earlier pig iron formation steps and subsequent processing. Simply stated, the fuel briquette of this invention can be used to replace coke in whole or in part wherever it is used as a fuel reductant, e.g., in a blast furnace, other reduction processes, in a foundry cupola, etc. Such processes are so well known that no further discussion is believed necessary. The present invention modifies such processes merely by replacing, in whole or in part, the coke conventionally used therein with the fuel briquette of the present invention; no other changes of substance are needed since the fuel briquette of the present invention essentially retains the product characteristics of the present coke from which it is formed and thus will show substantially the same volatile matter, ash, sulfur and phosphorous content and moisture content (unless stored under very humid conditions). The minor amount of ammonium polyphosphate binder does not adversely affect these base characteristics, and permits the fuel briquette of this invention to be used in layered form similar to metallurgical coke and not to break down to any harmful extent under the weight of the overlying limestone and steel scrap or iron ore, or under heat, until the entire melt has finished processing.

While not limitative, illustrative of blast-furnace operations wherein the fuel briquette of the present invention finds use as a partial or complete replacement for coke (or a coke-type material used therein) are those described in U.S. Pat. Nos. 3,537,841 Wendel, 3,522,034 Bailey, 3,239,331 Menk et al, etc.

While the invention has been described in detail and with reference to specific embodiments thereof, it will be apparent to one skilled in the art that various changes and modifications can be made therein without departing from the spirit and scope thereof.

What is claimed is:

1. A fuel briquette formed from a composition comprising coke breeze, magnesia and an aqueous ammonium polyphosphate solution, said magnesia and aqueous ammonium polyphosphate solution being present in an amount effective to bind said coke breeze into said fuel briquette form.

2. The fuel briquette of claim 1, wherein said aqueous ammonium polyphosphate solution comprises ammonium orthophosphate and one or more ammonium polyphosphate.

3. The fuel briquette of claim 2, wherein said polyphosphates comprise at least 20 wt.% of the total phosphate present.

4. The fuel briquette of claim 3, wherein said polyphosphates comprise at least 60 wt.% of the total phosphate present.

5. The fuel briquette of claim 3, wherein said aqueous solution of ammonium polyphosphate comprises at least about 30 wt.% phosphates.

6. The fuel briquette of claim 2, wherein said phosphates provide an amount of phosphate of at least about 1 part as $P_2O_5$ based on 100 parts of coke breeze and magnesia.

7. The fuel briquette of claim 6, wherein said amount is at least about 3 parts as $P_2O_5$, same basis.

8. The fuel briquette of claim 1, wherein said magnesia is present in said composition in an amount of at least 1 wt.% based on composition weight.

9. The fuel briquette of claim 8, wherein said magnesia is selected from the group consisting of calcined magnesia, dead-burned magnesia and calcined dolomite.

10. The fuel briquette of claim 8, wherein said magnesia comprises at least about 80 wt.% MgO.

11. The fuel briquette of claim 1, wherein said coke breeze has a size of about pass 1" mesh or less.

* * * * *